US006691828B1

(12) United States Patent
Hayman et al.

(10) Patent No.: US 6,691,828 B1
(45) **Date of Patent: *Feb. 17, 2004**

(54) SCAFFOLD STAIR

(75) Inventors: Yates Westley Hayman, Walker, LA (US); Kenneth Ray Hensley, St. Amant, LA (US)

(73) Assignee: Deltak Manufacturing, Inc., Walker, LA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/173,475

(22) Filed: Jun. 14, 2002

Related U.S. Application Data

(63) Continuation-in-part of application No. 09/709,115, filed on Nov. 8, 2000, now Pat. No. 6,415,891.

(51) Int. Cl.[7] ..... E04G 7/00

(52) U.S. Cl. ..... 182/178.1; 182/194; 52/82; 52/183

(58) Field of Search ..... 182/120, 121, 182/122, 93, 97, 129, 178.1, 194; 52/82, 183

(56) References Cited

U.S. PATENT DOCUMENTS 553,487 A * 1/1896 Godfrey ..... 182/178.1
3,099,336 A * 7/1963 Hawkins ..... 182/178.1 X
3,565,212 A * 2/1971 Johnson ..... 182/222
3,713,511 A * 1/1973 Hinkle ..... 182/95
3,837,427 A * 9/1974 Mattinson ..... 182/115
4,024,929 A * 5/1977 Mintz ..... 182/151
4,053,028 A * 10/1977 Loix ..... 182/1
4,406,347 A * 9/1983 Stathopolous ..... 182/1
4,457,398 A * 7/1984 Loix ..... 182/151
4,586,585 A * 5/1986 Zaner ..... 182/97
4,586,586 A * 5/1986 Canals ..... 182/118
4,631,880 A * 12/1986 Leicht ..... 52/105
4,959,935 A * 10/1990 Stob ..... 52/183
5,010,699 A * 4/1991 Maiuccoro et al. ..... 52/169.8
5,014,475 A * 5/1991 Anderson, Jr. et al. ..... 52/19
5,086,595 A * 2/1992 Maiuccoro et al. ..... 52/183
5,186,588 A * 2/1993 Sutton et al. ..... 410/120
5,189,854 A * 3/1993 Nebel ..... 52/183
5,429,207 A * 7/1995 Frank et al. ..... 182/209
5,495,915 A * 3/1996 Weston et al. ..... 182/195
5,636,483 A * 6/1997 Wille ..... 52/188
5,692,581 A * 12/1997 Nelson et al. ..... 182/129
5,788,011 A * 8/1998 Kemmer et al. ..... 182/96
5,988,318 A * 11/1999 Krause ..... 182/222
6,354,403 B1 * 3/2002 Truckner et al. ..... 182/228.1
6,405,830 B1 * 6/2002 Hayman ..... 182/113
6,415,891 B1 * 7/2002 Hayman et al. ..... 182/178.1
6,419,047 B1 * 7/2002 Adshead ..... 182/180.2

* cited by examiner

*Primary Examiner*—Bruce A. Lev
(74) *Attorney, Agent, or Firm*—Jones, Walker, Waechter, Poitevent, Carrere & Denegre, L.L.P.

(57) ABSTRACT

A scaffold stringer which is a plate and a series of tread mounts attached at substantially uniform distances along the plate, the tread mounts forming an angle with the plate, each tread mount having an associated finger projection positioned above each tread mount and projecting outwardly from the stringer, the scaffold stringer additionally has least one attachment member for attaching the stringer to a scaffold structure.

13 Claims, 7 Drawing Sheets

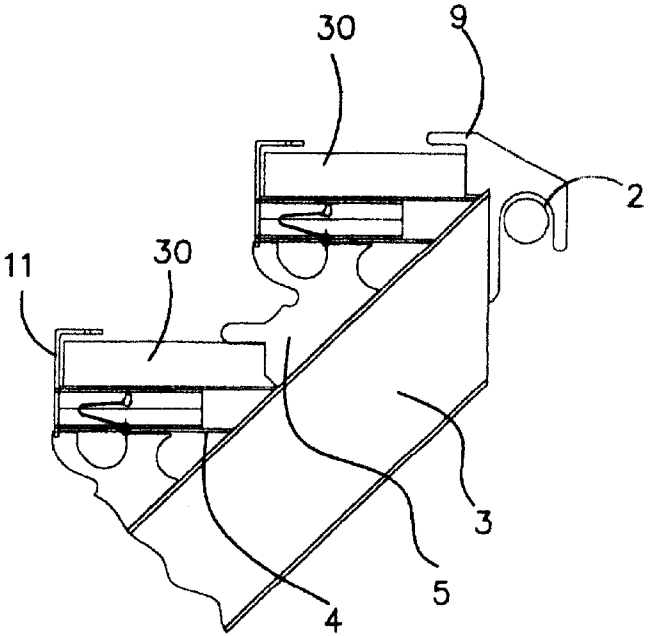
FIG 3B
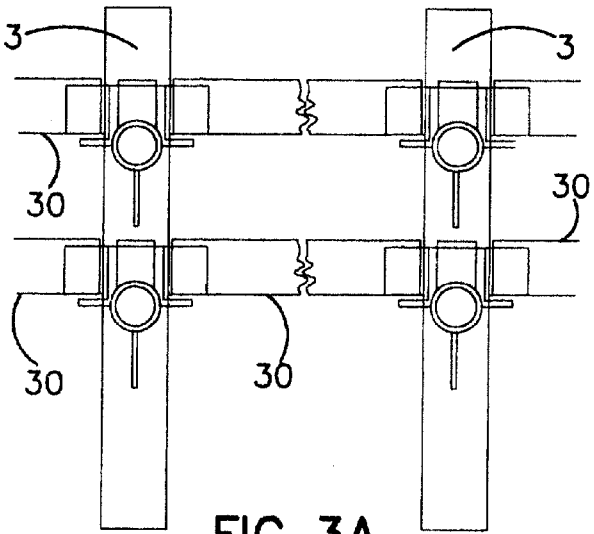
FIG 3A
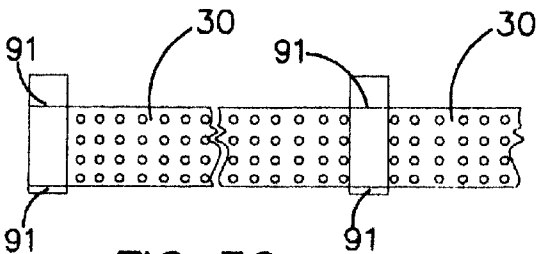
FIG 3C
FIGURE 3

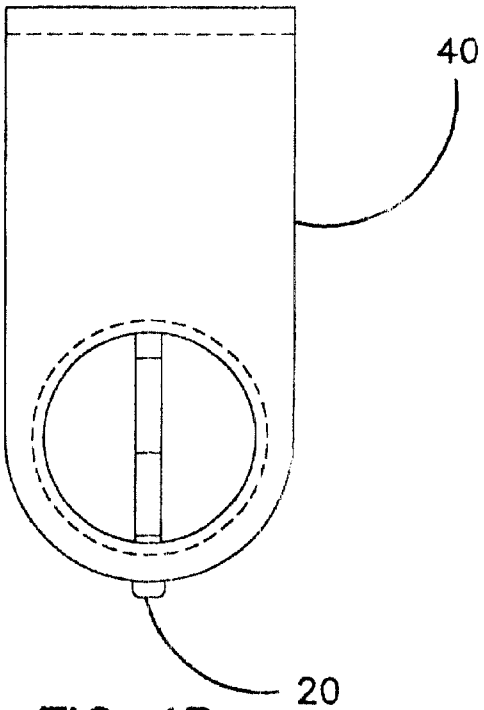
FIG 4B
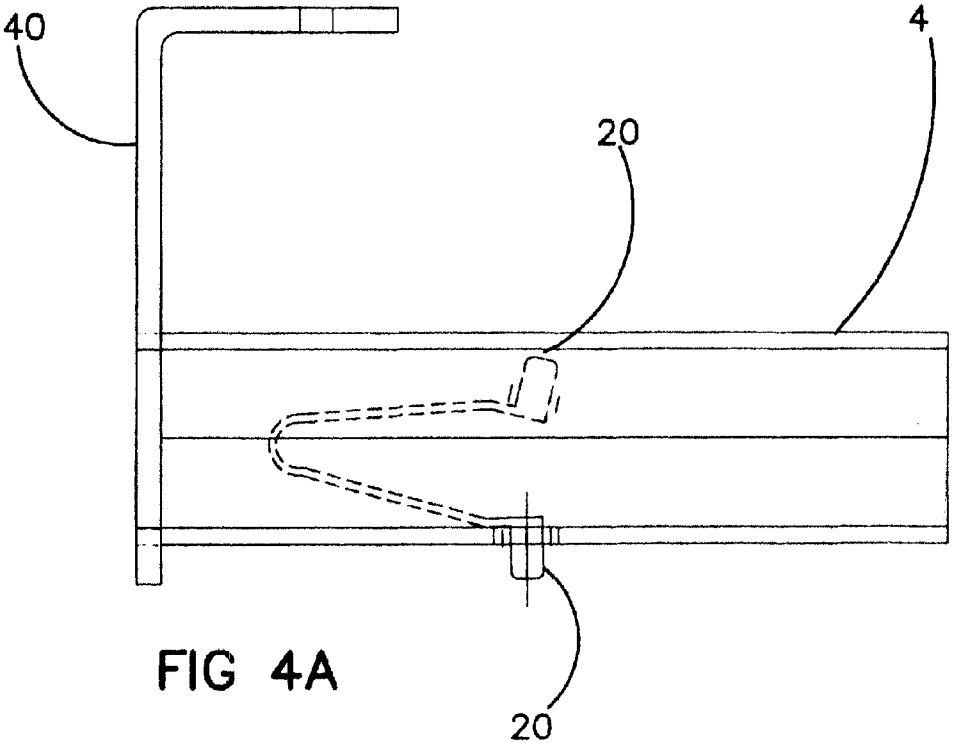
FIG 4A
FIGURE 4

SCAFFOLD STAIR

This application is a continuation-in-part of application Ser. No. 09/709,115, filed Nov. 8, 2000 and entitled "An Improved Scaffold Stair," now U.S. Pat. No. 6,415,891.

FIELD OF INVENTION

This invention relates to scaffold structures, and, in particular, to stairs for scaffold structures.

BACKGROUND OF THE INVENTION

Devices for accessing or mounting a scaffold platform generally consists of ladders, either added onto the structure of the scaffold structure or climbing the structure of the scaffold itself. That is, using the horizontal scaffold members as ladder rungs for climbing. Unfortunately, the climber is generally outside the scaffold structure in a fairly precarious situation. Upon reaching the deck, the climber must climb up the structure and swing his legs onto the deck, again in a precarious situation.

OBJECTS OF THE INVENTION

It is an object of the invention to provide a scaffold stair distinct from the scaffold structure.

It is an object of the invention to provide an easy to assemble scaffold stair.

It is an object of the invention to provide a scaffold stair with locks for holding stair treads in place.

It is an object of the invention to provide a scaffold stair system, which can be assembled into bleachers.

SUMMARY OF THE INVENTION

A scaffold stair having stringers and a series of tread mounts attached at substantially uniform distances along the stringer, each tread mount has an associated finger projection, said finger projection being positioned above each tread mount and projecting away from the stringer. Each stringer has an attachment member for attaching the stringer to a scaffold structure. The scaffold stairs additionally having a series of treads positioned on the tread mounts.

BRIEF DESCRIPTION OF THE DRAWINGS

FIG. 3A is a front view of the scaffold stairs set up as a seat.

FIG. 3B is a side view of a scaffold stair stringer showing details of the latch mechanism.

FIG. 3C is a top view of a scaffold stair tread.

FIG. 4A is a side view of the latch mechanism.

FIG. 4B is a front view of the latch mechanism.

DETAILED DESCRIPTION OF THE INVENTION

Figure 1:
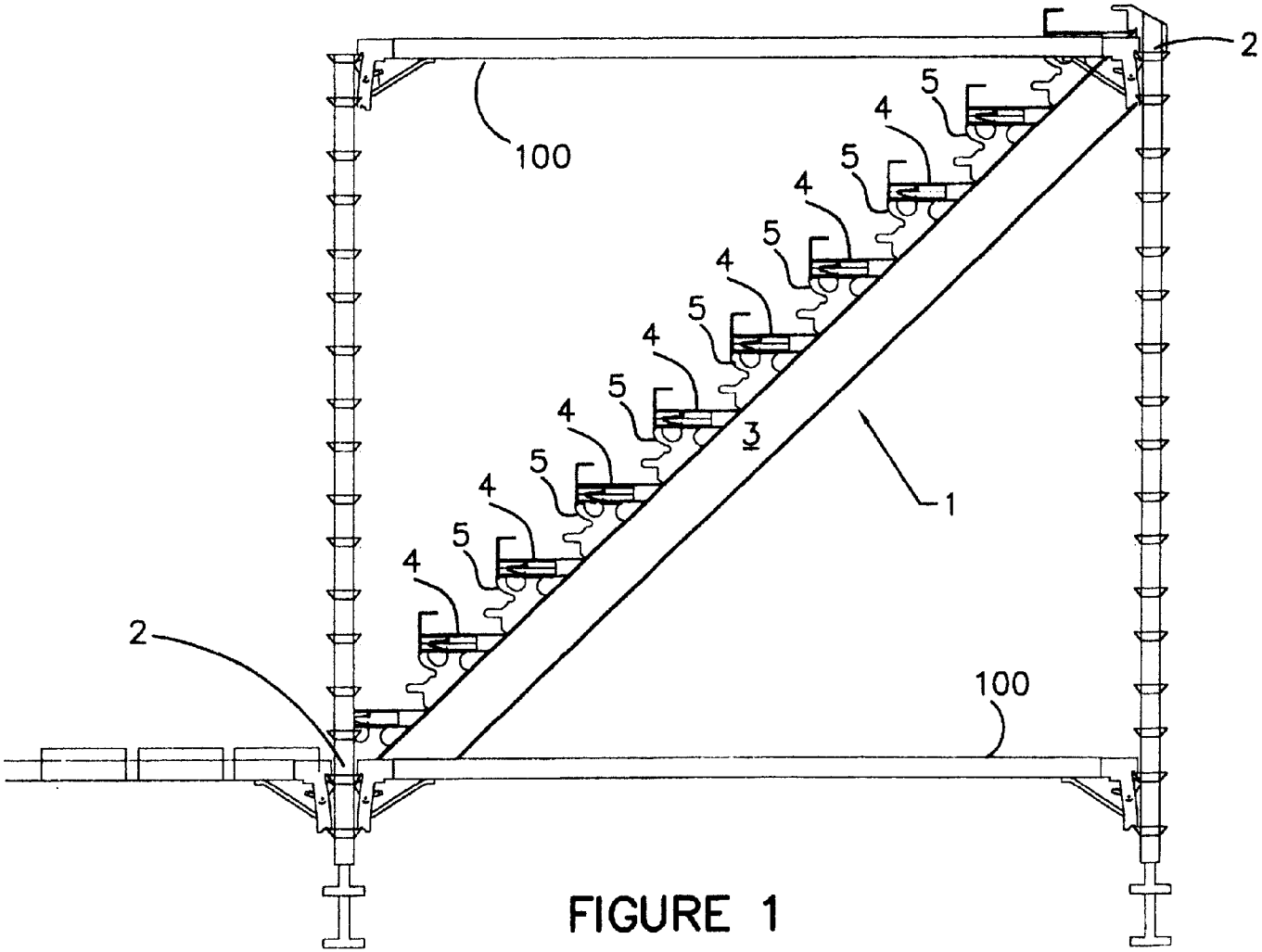
FIG. 1 depicts a side view of a scaffold structure with the scaffold stairs installed.

The invention is scaffold stairs designed to be assembled in the field and attachable to a scaffold structure having horizontal members 100 and vertical members. In general, the stairs will be attachable to the structure's horizontal members. As shown in FIG. 1, the scaffold stairs include stair stringers 1, and a series of stair treads 30 (see FIG. 3B) positioned thereon. Each stair stringer is a plate 3, with a series of tread mounts 4 positioned thereon. As shown, each tread mount 4 is a tube rigidly fixed to the stringer 1 (such as by welding or other conventional means) and spaced uniformly along the stringer 1. Tread mount 4 is "rigidly fixed" to stringer 1 in the sense that it may not rotate or pivot on stringer 1. Additionally, as shown, tread mount support 5 attaches each tread mount 4 to the stringer 1. Tread mount support 5 provides additional support and rigidity to the tread mount/stringer connection.

Figure 2:
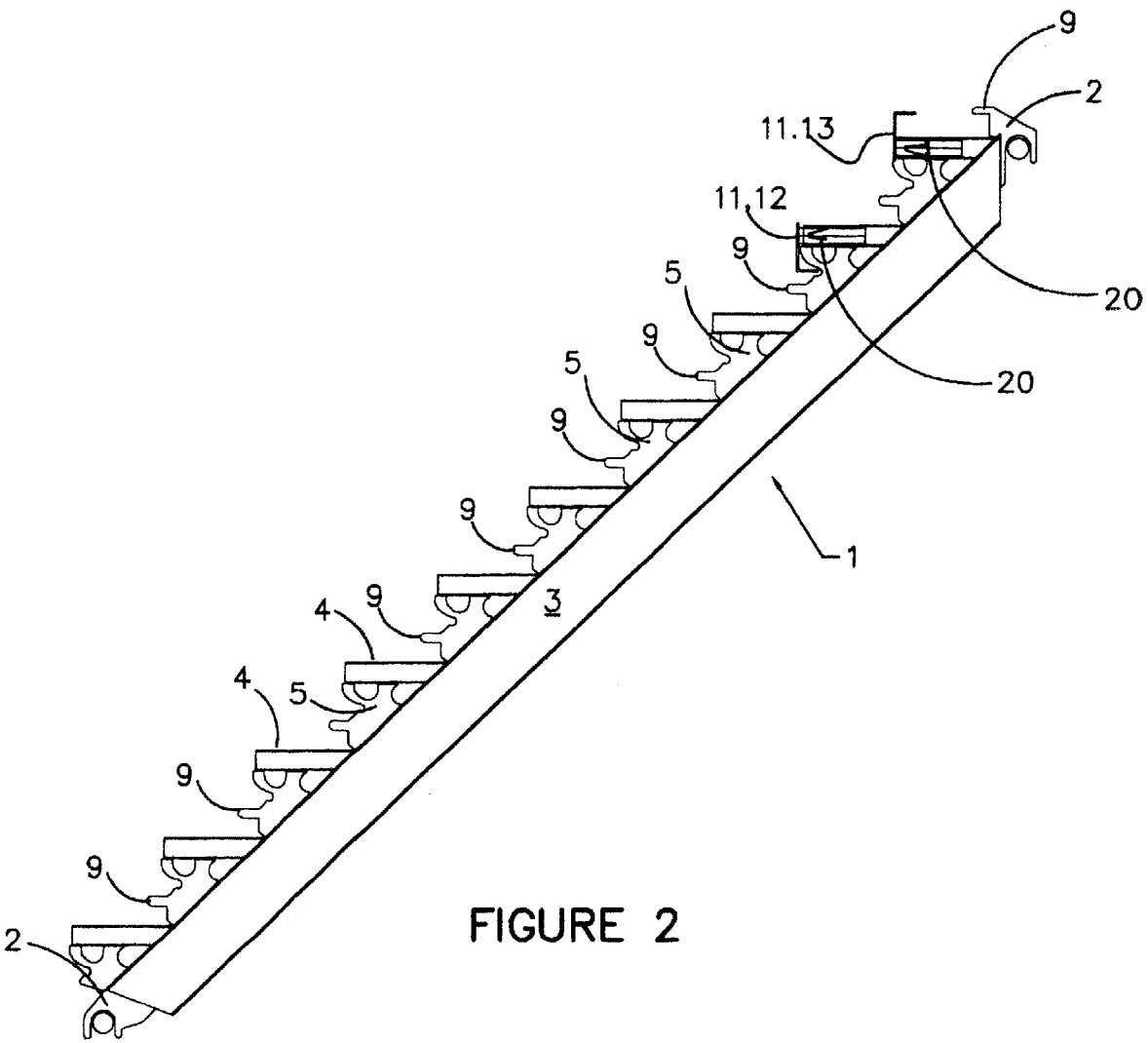
FIG. 2 is a detailed side view of one embodiment of a scaffold stair stringer.
Figure 5:
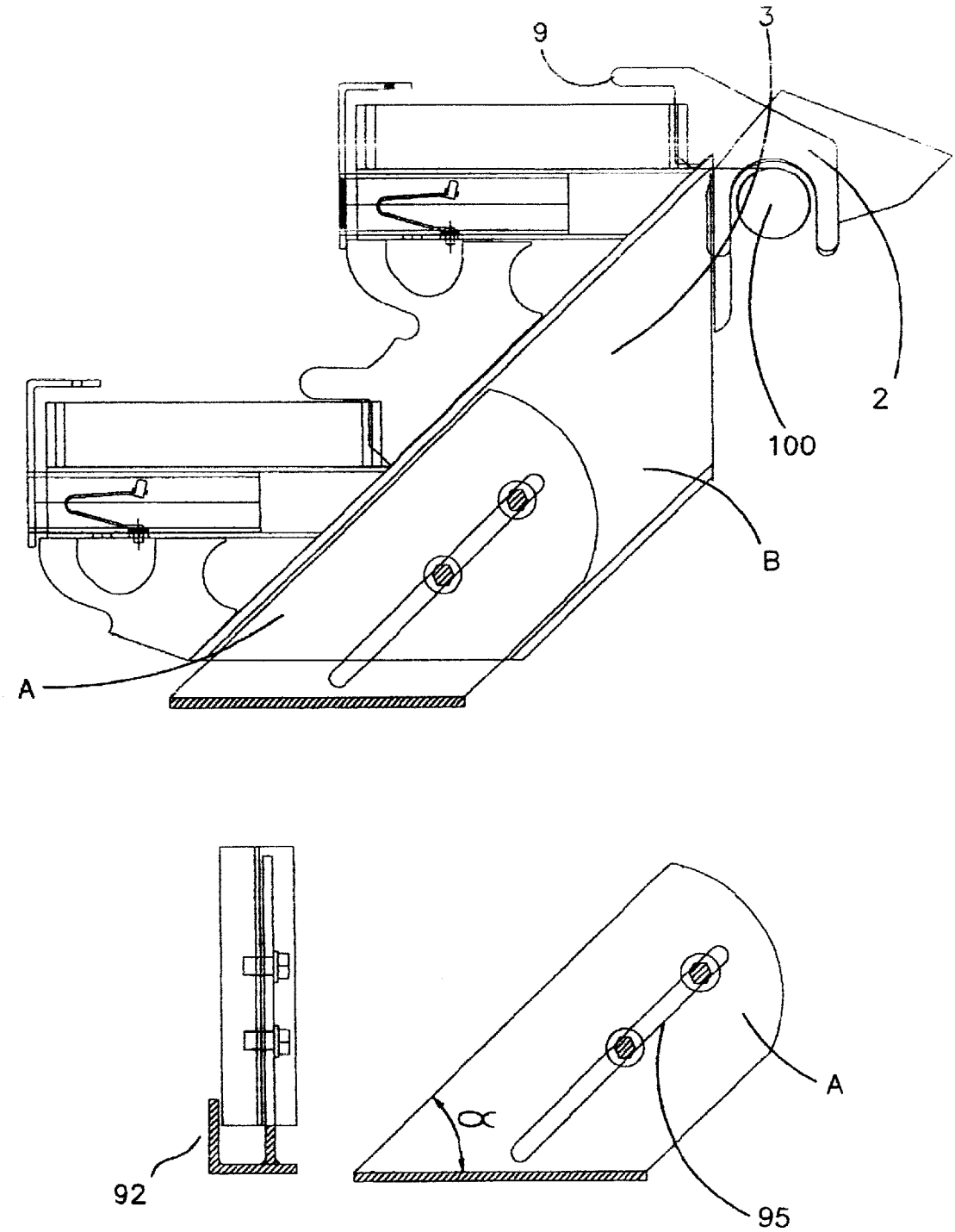
FIG. 5 is a side view of a ground contacting scaffold stair stringer.

Each stringer 3 has an attachment member 2 placed on at least one end for attaching to the scaffold structures, preferably the scaffold structure's horizontal members. As shown in FIG. 2, the attachment members 2 are hook shaped plates designed to latch or hook onto the horizontal scaffold members 100. As shown, the stringer 3 has two attachment members 2, one at each end. In the embodiment seen in the figures, the hooked shaped plates are rigidly and non-pivotally attached to stringer 3. Some stringers 3 may have a single attachment member 2. For instance, the stringers of the stairs which rest on the ground obviously would not require an attachment member 2 at ground level, as is shown in FIG. 5.

As shown in FIG. 2, above each tread mount 4 is a projecting finger 9. Projecting finger 9, as shown, is part of a tread mount support 5, but the projecting finger 9 could be a separate member. The projecting finger 9 shown is "L" shaped. The back of the "L" is sized slightly larger than an expected tread thickness so that a tread 30 can be butted against the back of the "L," and have the top of the "L" project over the tread 30. In such a fashion, the projecting finger 9 acts to trap the tread between the projecting finger 9 and tread mount 4 and prevent upward movement and accidental dislodgment of the tread.

Viewing FIGS. 2 and 3, at the end of the tread mount 4, distal from the stringer 3, is a latch member 11. As best seen in FIG. 2, the latch member 11 is movably attached to the tread mount 4 between a first unlocked position 12 and a second locked position 13. As shown, the latch member 11 is a sleeve insertable into the tread mount 4 (see FIG. 4). The end of the sleeve is an "L" shaped bracket 40 for engaging the front of a stair tread when placed upon the tread mount. This sleeve is rotatable in the tread mount 4, and the latch members 11 position with respect to the tread mount 4 is fixed by buttons 20 which protrude through the sleeves outer surface and which are engagable with holes in the tread mount 4 (not shown). The latching mechanism shown included two buttons 20 positioned on the sleeve 180 degrees apart. The buttons are positioned on a clip that is insertable into the interior of the sleeve (see FIG. 4). Latch member sleeve 11 is rotatable between a first unlocked position 12 (the "L" orientated downward and riding in a slot cut in the plate) and a second locked position 13 (the "L" orientated upward to have the end of the "L" project over a tread mounted on the tread mounts). The sleeve may also be movable outwardly from the tread mount 4 (away from the stringer) to accommodate placement of the latch member sleeve 11 in the locked position (move sleeve outward, rotate up, and move inward to the locked position). Additionally, adjustment of the sleeve outwardly allows the operator to accommodate minor variations in stair tread sizes.

Shown in FIG. 3A is a top view of a tread 30 mounted on two stringers 3. As shown in FIG. 3C, each tread 30 is a metal plate having two hooks 91 at each end for attaching to the tread mounts 4. Obviously, the tread could be a wood board or board made from other materials. As shown, the treads 30 are constructed much like a metal scaffold board. The hooks 91 could be positioned below the tread 30 (not shown) to cover the tread mounts with the tread plate or foot contact area, or the hooks 91 may extend beyond the tread plate or foot contact area as is shown in FIG. 3. The arrangement in FIG. 3 allows two treads 30 to be placed side-by-side. In this fashion, a series of stringers 3 may be placed parallel to each other to form the structure of a bleacher or stands, with side-by-side treads 30 forming the seats of the stands.

Shown in FIG. 5 is a stringer 3 adapted for placement on the ground. The ground end of this stringer 3 has no hook section 2. Instead, the ground end is simply the stringer plate 3 cut at a suitable angle alpha. Alternatively, the ground-level stringer 3 may be two plates that are adjustable with respect to each other. For instance, shown in FIG. 5 are plates A & B, where plate A has a slot 95 through which bolts are attached into plate B, thereby joining plates A & B in an adjustable manner. As shown, bottom-resting plate A also has a ground plate or pad 92 on the ground side to increase the ground contact area. In the embodiment shown, ground plate 92 is capable of being adjusted in an axial direction parallel to said stringer. If the slots 95 are sufficiently wide, plate A can be adjusted to accommodate minor differences in the ground contact angle alpha.

Figure 6:
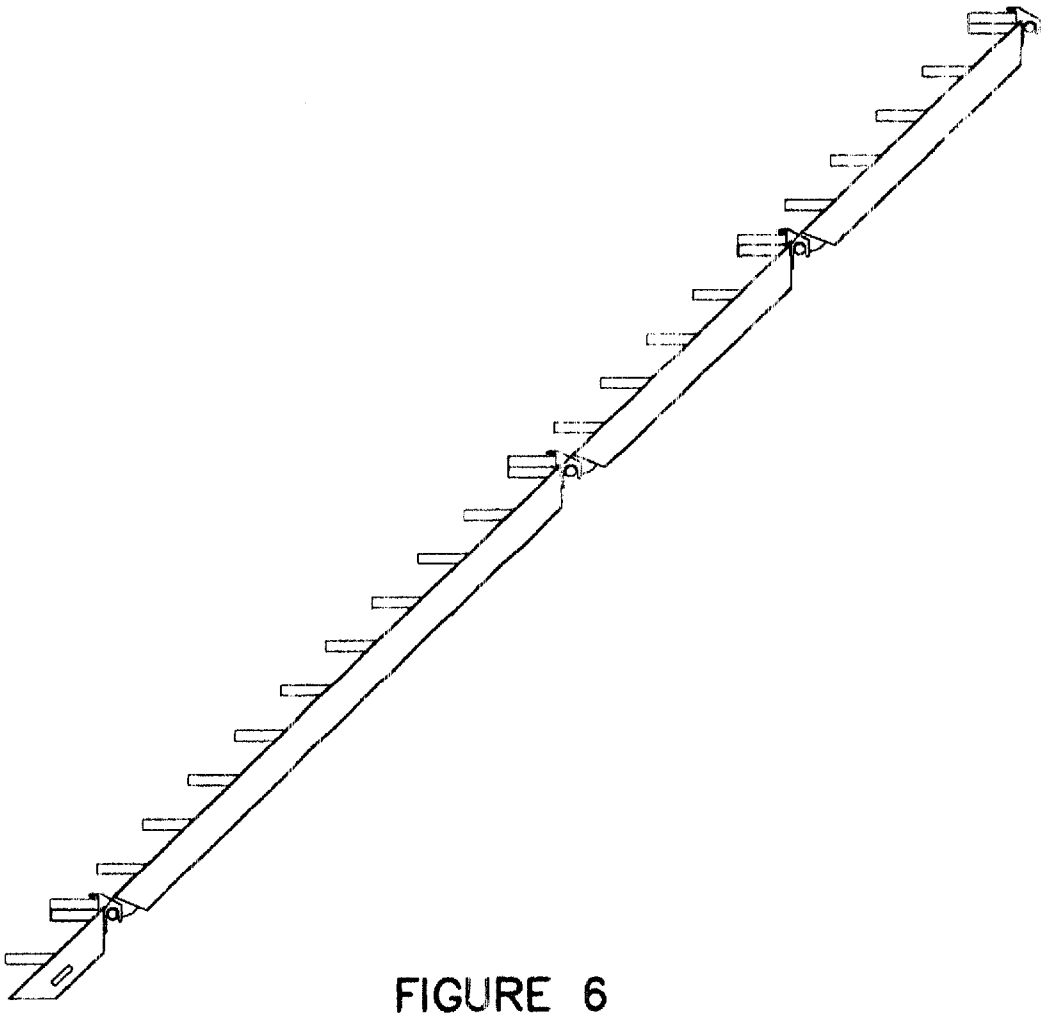
FIG. 6 is a side view of a series of scaffold stairs.
Figure 7:
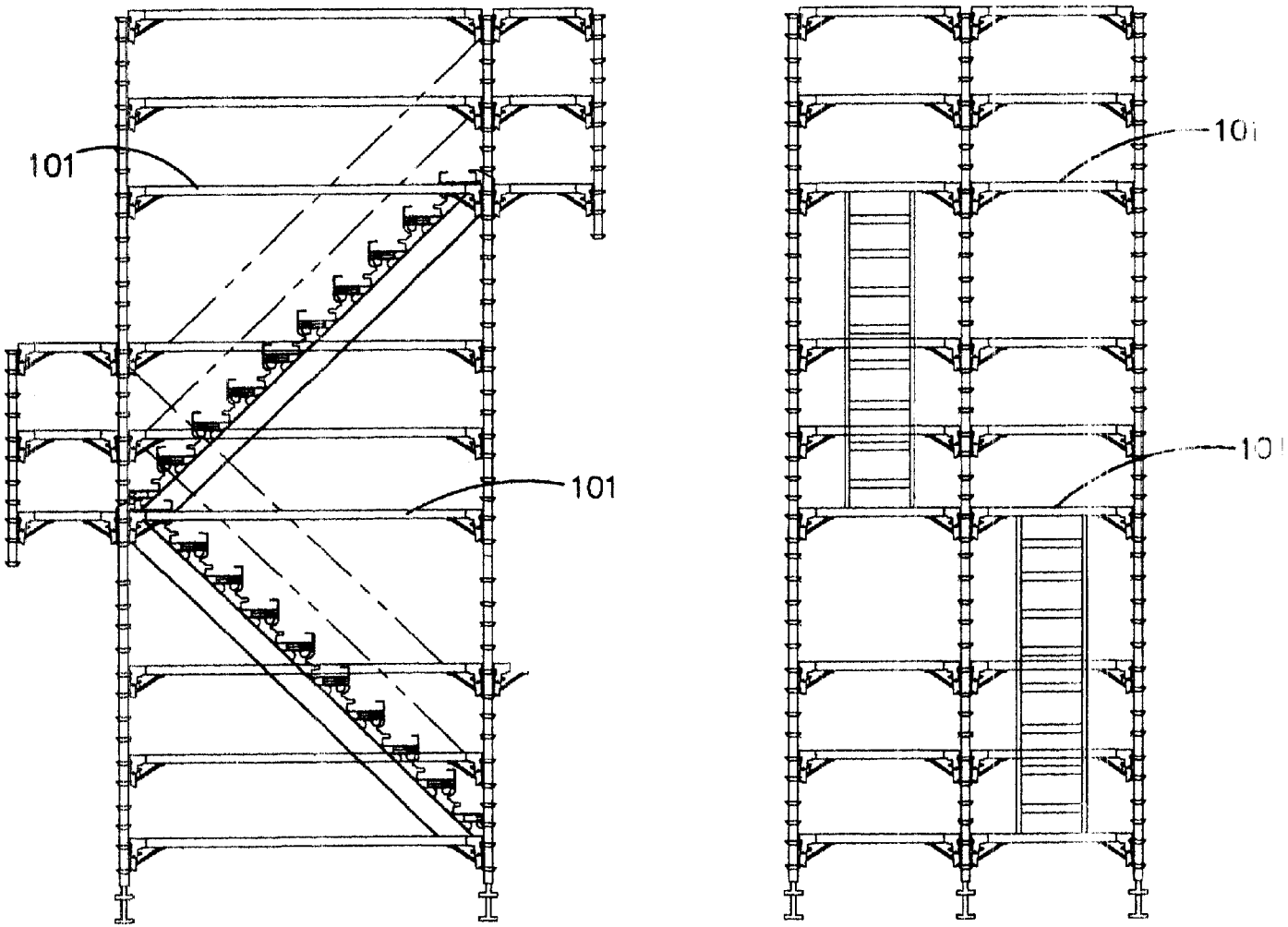
FIG. 7 shows two side views of the scaffold stairs in a switchback configuration.

Finally, a series of stringers can be assembled in conjunction with a scaffold frame to create a scaffold stair. If the scaffold structure is large enough, the stringers can be assembled into a continuous rise, as is shown in FIG. 6. If the scaffold structure is more spatially restrictive, the stairs may be assembled in a series of switchback sections, as is shown in FIG. 7. As indicated in FIG. 7, at each switchback, a deck 101 must be provided to allow the user to move from one stair riser section to the next. Additionally, as shown, the deck 101 will generally extend beyond the scaffold structure requiring the need for bracing of the extension and for safety railing.

Although the present invention has been described in terms of specific embodiments, it is anticipated that alterations and modifications thereof will no doubt become apparent to those skilled in the art which are intended to be included within the scope of the following claims.

We claim:

1. A scaffold stair attachable to a scaffold structure having vertical and horizontal members, said scaffold stair comprising:

a. at least two stringers, each stringer having a first and second end;

b. a series of tread mounts rigidly fixed to said stringers and spaced at substantially uniform distances along said stringer, wherein each of said tread mounts includes a finger projection, said finger projections being positioned above said tread mount and projecting outwardly from an upper surface of said stringer to resist removal of said treads positioned on said tread mounts by an upper force;

c. an attachment member rigidly and non-pivotally positioned on said first end of said stringers, said attachment member adapted to engage a scaffold structure;

d. a series of treads, each of said treads positionable across said tread mounts; and e. a plate positioned on said second end of two of at least two said stringers, said plate being adjustable relative to said stringers.

2. The scaffold stair according to claim 1, wherein said attachment member is adapted for connection with a substantially round scaffold structure.

3. The scaffold stair according to claim 1, wherein said plate is continuously fixedly adjustable over a predetermined range in an axial direction parallel to said stringers.

4. The scaffold stairs according to claim 3 wherein said plate further is rotatably adjustable relative to said stringer.

5. A scaffold stair attachable to a scaffold structure having vertical and horizontal members, said scaffold stair comprising:

a. at least two stringers, each stringer having a first and second end;

b. a series of tread mounts rigidly fixed to said stringers and spaced at substantially uniform distances along said stringer;

c. an attachment member rigidly and non-pivotally positioned on said first end of said stringers, said attachment member adapted to engage a scaffold structure;

d. a series of treads, each of said treads positionable across said tread mounts; and e. a plate positioned on said second end of two of at least two said stringers, said plate being adjustable relative to said stringers, f. a plurality of latches, each of said latches being attachable to one of said tread mounts, said latches, when attached to said tread mount, being adapted to retain a tread positioned across said tread mount against an upward force.

6. The scaffold stair according to claim 5 wherein said latches are adapted to retain a tread by being movable with respect to said tread mount between a first locked location and a second unlocked location.

7. The scaffold stairs according to claim 5 wherein each of said latches has an end plate that is "L" shaped.

8. A scaffold stair attachable to a scaffold structure having vertical and horizontal members, said scaffold stair comprising:

a. at least two stringers, each stringer having a first and second end;

b. a series of tread mounts attached at substantially uniform distances along each of said stringers, said tread mounts being rigidly fixed to each of said stringers;

c. an attachment member positioned on said first end of each of said stringers, said attachment member adapted to engage a scaffold structure;

d. a series of treads, each of said treads positionable across said tread mounts;

e. a latch for retaining said treads attached to each of said tread mounts, said latches being movable between a locked and unlocked position; and f. a plate positioned on said second end of two of at least two said stringers, said plate being fixed at an angle relative to said stringers.

9. A scaffold stair according to claim 8 further having a plurality of latches, each of said latches being attachable to one of said tread mounts, said latches, when attached to said tread mount, being adapted to retain a tread positioned across said tread mount against an upward force.

10. A scaffold stair according to claim 8 wherein said latches are adapted to retain a tread by being movable with respect to said tread mount between a first locked location and a second unlocked location.

11. A scaffold stair according to claim 8 wherein each of said latches has an end plate that is "L" shaped.

12. A scaffold stringer according to claim 8 wherein said plate is rotably adjustable relative to said stringers.

13. A scaffold stair attachable to a scaffold structure having vertical and horizontal members, said scaffold stair having:

a. at least two stringers, each stringer comprising a plate with two sides and an upper and a lower surface;

b. a series of tread mounts attached at substantially uniform distances along said upper surface of each of said stringers, each of said tread mounts forming an angle with said plate, c. each of said stringers having an attachment member positioned on at least one end of said stringers, said attachment member adapted to engage a scaffold structure; and d. each tread mount having a latch, said latch being movable to a locked and an unlocked position on said tread mount, said latches, when in a locked position, being adapted to retain a removable tread positioned across said tread mount against an upward force.

* * * * *